United States Patent [19]

Haddock

[11] 4,280,433

[45] Jul. 28, 1981

[54] UNDERWATER APPENDAGES FOR VESSELS

[76] Inventor: Cecil F. Haddock, Mt. Maurice, Clyde Park, Burua, via Gladstone, Queensland, Australia, 4860

[21] Appl. No.: 961,650

[22] Filed: Nov. 17, 1978

Related U.S. Application Data

[63] Continuation-in-part of Ser. No. 778,008, Mar. 16, 1977, abandoned.

[30] Foreign Application Priority Data

| | | | |
|---|---|---|---|
| Mar. 19, 1976 | [AU] | Australia | PC5270 |
| Jun. 7, 1976 | [AU] | Australia | PC6193 |
| Oct. 13, 1978 | [AU] | Australia | PD6367 3 |

[51] Int. Cl.[3] ..... B63B 3/38

[52] U.S. Cl. ..... 114/140; 114/126; 114/127; 114/132

[58] Field of Search ..... 114/140, 127, 128, 132, 114/133, 162, 167, 149, 126, 169, 172, 142, 144 R; 244/219

[56] References Cited

U.S. PATENT DOCUMENTS

| | | | |
|---|---|---|---|
| 978,746 | 12/1910 | Heusted | 114/144 R |
| 2,572,134 | 10/1951 | Gliwa | 114/162 X |
| 3,080,845 | 3/1963 | Pollak | 114/140 |
| 3,467,045 | 9/1969 | Brohl | 114/167 |
| 3,753,415 | 8/1973 | Burtis | 114/126 |
| 3,999,496 | 12/1976 | Mirande | 114/162 X |

*Primary Examiner*—Sherman D. Basinger
*Attorney, Agent, or Firm*—DeLio and Montgomery

[57] ABSTRACT

A keel assembly or similar fin-like underwater appendage for a boat is provided which is adjustable to adapt its characteristics to the operating conditions of the boat, for example to optimize hull performance of a sailing boat on opposite tacks. The assembly comprises a support and a pair of curved flexible side plates carried by the support and connected at their leading and trailing edges, the curvature of the side plates being adjustable to render the assembly asymmetrical. The leading and trailing portions of the plates are provided by blade assemblies interconnected so as to be oppositely pivotable about axes parallel to leading and trailing edges of the support, the trailing blade assembly having its pivoted axis adjacent its leading edge.

6 Claims, 15 Drawing Figures

UNDERWATER APPENDAGES FOR VESSELS

BACKGROUND OF THE INVENTION

This is a continuation-in-part of my co-pending application Ser. No. 778,008 for "Improvements to Underwater Appendages for Vessels" filed Mar. 16, 1977, now abandoned.

FIELD OF INVENTION

The present invention relates to improvements to underwater appendages for vessels such as yacht keels adapted to derive lift from forward passage through the water.

DESCRIPTION OF PRIOR ART

Many attempts have been made in the past to provide an underwater appendage which, say, when used as a keel of a sailing vessel, will give positive lift to windward. U.S. Pat. No. 3,753,415 of Burtis illustrates a typical prior proposal attempting to provide a keel which may be disposed asymmetrically, depending upon the tack of the vessel, to give positive lift to windward. It will be seen that this specification teaches the provision of a keel having a flexible casing which may be disposed asymmetrically and having a support structure which may be a solid mass metal to constitute the ballast keel of the vessel. In this respect, it is necessary for successful operation of an articulated keel for a vessel which operates in an adverse environment, usually a salt water environment, to be of simple nature so that its operation will not be affected by marine growth and electrolysis and which may be easily dismantled for regular cleaning when the vessel is slipped. Additionally, the keel must be capable of supporting the whole weight of the vessel during slipping and be able to take impact loads, such as when the vessel runs aground or sits on the hard.

In this respect, it will be seen that the Burtis specification was an attempt to satisfy these requirements in the light of the various teachings of, for example, the Lake specification, U.S. Pat. No. 1,890,059, and other earlier teachings such as U.S. Pat. Nos. 3,118,639 of Kiceniuk, 1,689,779 of Hiorth, Netherlands Pat. Nos. 51,251 and 50,343 of Roos, and French Pat. No. 1,409,241 of Eversolt.

Noticeably, Burtis did not incorporate the teachings of Lake so as to incorporate fore and aft pivot assemblies for supporting the outer casing as the earlier teachings were in respect of air foil sections having intricate mechanisms which would not continue to operate successfully in an underwater environment when, say, fouled with marine growth. In particular, the solution was not given by the earlier teachings as to how to achieve successful operation of a foil supported between fore and aft pivot assemblies which would operate underwater while at the same time leaving the necessary space for the location of the desired quantity of ballast which may range from say thirty percent to sixty percent of the total weight of the vessel together with robustness.

Thus, the Burtis specification settled on a keel configuration which could be disposed asymmetrically to assist in windward performance while still providing a relatively simple robust appendage. It is well known that the lift to drag ratio for an asymmetrical foil is not greatly increased over that of a symmetrical foil unless the foil can be arranged at a positive angle of attack to the direction of motion. In the past this was achieved by the sailing vessel heading with its fore and aft axis upward of its true course. This technique is fully explained in "Sailing Yacht Design" by Robert G. Henry and Captain Richards T. Miller, USN (published by Cornell Maritime Press, Inc. 1965). However, this "Yaw" angle greatly increases the resistance in the vessel to movement along its true course.

SUMMARY OF THE INVENTION

My present invention has been devised to provide a keel which will be of robust construction so that it can take grounding without fear of additional damage and will support the vessel when slipped and, furthermore, the keel according to my present invention has been devised so that it can be quickly stripped on the slipway for defouling and will enable the necessary internal ballast to be carried within the keel, even when the latter has an aspect ratio of 1 to 1.25 or greater for best lift to drag ratios.

In addition, according to a preferred form, my invention provides an articulated keel assembly which may be disposed in either asymmetrical shape to provide lift to starboard or to port and a symmetrical shape and which will automatically articulate from one shape to another dependent upon the course of the vessel. Of course, manual override means may be incorporated.

Accordingly, with the foregoing and other objects in view, this invention resides broadly in a fin assembly of the type having mounting means connectible to the underside of a vessel and a support structure fixed to and extending outwardly from said mounting means for supporting a foil shaped outer casing in such manner that the incidence plane of the symmetrical foil is substantially parallel to the fore and aft axis of the vessel and the sides of the casing are spaced from said support structure, and wherein the casing is formed of flexible material whereby the respective opposite sides of said casing may move towards or away from said support structure to alter shape to an asymmetrical foil, characterised in that said casing is supported between normally freely pivotable fore and aft pivot assemblies connected pivotably about outwardly extending axes disposed substantially parallel to said incidence plane and adjacent the respective leading and trailing edges of said mounting means and wherein said aft pivot assembly is pivoted adjacent its leading edge to permit its trailing edge to be displaced laterally either side of its normally symmetrical position, whereby the incidence plane of the asymmetrical foil may be disposed at a positive angle of attack with respect to the said fore and aft axis of the vessel thus increasing the lift/drag ratio of said asymmetrically disposed casing and torque transferring means interconnecting said fore and aft pivot assemblies to cause the latter to pivot oppositely to one another whereby said casing articulates automatically to a respective asymmetrical attitude due to water pressure against a respective side of said casing.

DESCRIPTION OF THE DRAWINGS

In order that the invention may be more readily understood and put into practical effect, reference will now be made to the accompanying drawings wherein.

DESCRIPTION OF THE PREFERRED EMBODIMENTS

Figure 1:
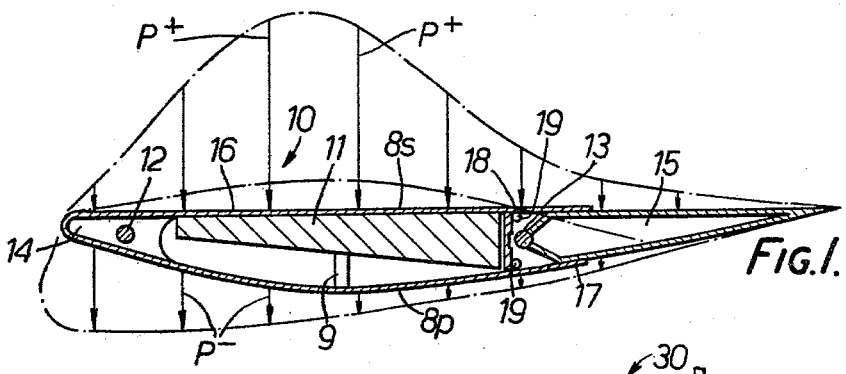
FIG. 1 is a cross-sectional view of a keel assembly as described in my co-pending patent application Ser. No. 778,008, filed Mar. 16, 1977.

In this embodiment illustrated in FIG. 1 the keel assembly 10 comprises a main vertical support member 11 intergral with an upper flange adapted to be connected to the underside of a vessel, and a lower flange for supporting the lower ends of fore and aft axles 12 and 13 respectively of fore and aft pivot assemblies 14 and 15, while the upper ends of the axles pass rotatably through the upper flange and, if desired, sealably through the underside of the vessel.

The vertical support member 11 is symmetrically shaped with either side face slightly concave to support the respective face of the feel casing 16, when disposed in either asymmetrical attitude, which casing is folded about the forward pivot assembly to extend rearward at either side therefrom to slidably overlap the aft pivot assembly, and the trailing end portions 17 of the casing are held together a distance apart substantially equal to the width of the forward portion of the aft pivot assembly by means of a vertically extending web 18 secured by hinges 19 at opposite sides to the respective trailing portions 17. The support member 11 is apertured so that a series of vertically spaced spacer pins 9 may be slidably located therein and adapted to maintain the opposite centre portions of the casing 16 at their desired distance apart.

In operation, the keel assembly according to this embodiment would be disposed symmetrically when sailing down-wind as the pressure against the starboard side 8*s* and the port side 8*p* of the casing would be equal. However, when the vessel is headed to windward, say on the port tack, the starboard casing side 8*s* will be subject to a positive water pressure the intensity distribution of which is indicated by the vectors P+ which will cause the casing side 8*s* to move laterally into abutting engagement with the corresponding concave face of the support member 11 and correspondingly move, via reaction of the spacer pins 9 and the negative pressure distribution as indicated by the lines P−, the opposite casing side 8*p* away from the support member 11 as illustrated, so that the leading portion of the casing assumes an asymmetrical shape. Furthermore, the disposition of the trailing portion 17 of the casing sides interconnected hingedly by the vertically extending web 18 will act on and pivot the aft pivot assembly 15 away from the fore and aft axis of the vessel towards the starboard side. Thus, as shown in my co-pending patent application, the fore and aft pivot assemblies are interconnected for simultaneous operation by means of the slidably overlapping trailing portions 17 of the casing 16.

In this respect, it will be seen that the positive pressure against the starboard face of the aft pivot assembly 15 does not prevent the latter pivoting to starboard as the cumulative pressure against the casing side 8*s* is much greater than the cumulative pressure against the starboard face of the aft pivot assembly 15. The keel assembly 10 disposed as shown in FIG. 1 will provide a positive lift towards the side which is the windward side of the vessel. When the vessel is on the opposite tack the port side will become the leeward side and the keel will automatically articulate to its asymmetrical position as shown in broken outline. In each case, it will be seen that the incidence plane, which is substantially parallel to the respective leeward faces of the foils when disposed in its respective asymmetrical attitudes are inclined to windward with respect to the plane passing through the fore and aft axes of the vessel so that the asymmetrically disposed keel is arranged at a positive angle of attack with respect to the fore and aft axes of the vessel whereby the lift/drag ratio of the keel is greatly increased to enable the vessel to sail more efficiently to windward.

Figure 13:
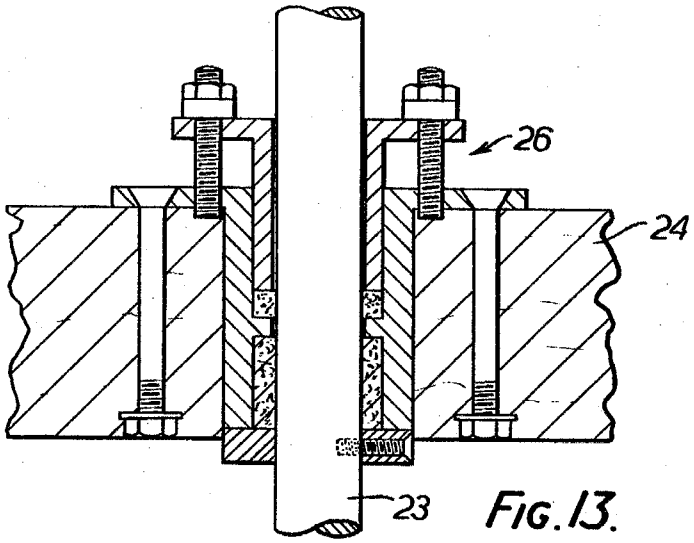
FIG. 13 illustrates the arrangement of the gland through which the operating shafts for the keel pass through the bottom of the boat.

In the preferred embodiment of the invention illustrated in the remaining drawings, the fore and aft pivot assemblies 20 and 21 are keyed to respective control shafts 22 and 23 which pass sealably through the bottom 24 of a boat 25 through glands 26 details of which are shown in FIG. 13 and connect at their upper end to respective lever arms 27 and 28 also keyed to their respective shafts 22 and 23 for movement therewith. The lever arms 27 and 28 are cross-linked by the linkage member 29 so that pivoting of the leading pivot assembly in one direction will be accompanied by pivoting of the aft pivot assembly in the opposite direction. The pivoting of the aft pivot assembly will result from torque applied to the leading shaft 22 resultant as previously described from positive pressure applied to the leeward side of the casing being transferred through the linkage member 29.

Figure 3:
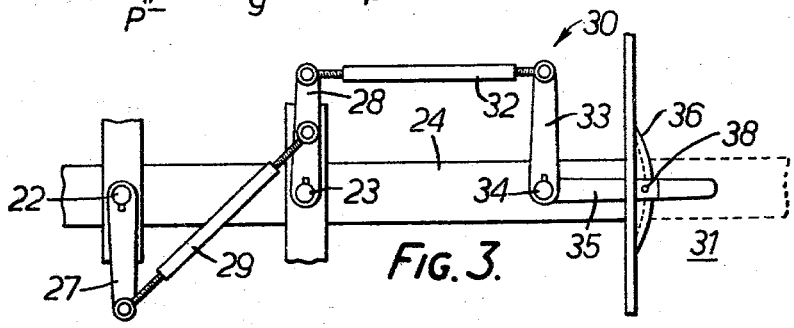
FIG. 3 is a plan view of the operative components of FIG. 2.

Additionally, a manual control linkage arrangement generally shown at 30 is provided so that the pivoting of pivot assemblies may be operatively controlled from say the cockpit 31 or the boat 25. For this purpose, a transfer link 32 extends from an extension of the lever 28 to a transfer lever 33 keyed to an upright transfer shaft 34 provided with, at its upper end, a hand operable lever 35 which extends through the cockpit 31. The outer end of the hand lever 35 is slidable past a quadrant member 36 fixed to the cabin wall 37 and provided with a plurality of spaced apertures through which a pin 38 may be inserted to engage with a co-operating aperture in the hand lever 35 to lock the assembly in a selected disposition, and of course, the articulated keel. The keel may operate automatically with the pin removed and the hand lever will simply move with the pivot assemblies to give an indication of the operative attitude to the keel assembly. Of course, it may be desirable when sailing downward to lock the keel assembly in a symmetrical attitude, and for this purpose, the hand lever is pinned in the central position as shown in FIG. 3.

Figure 5:
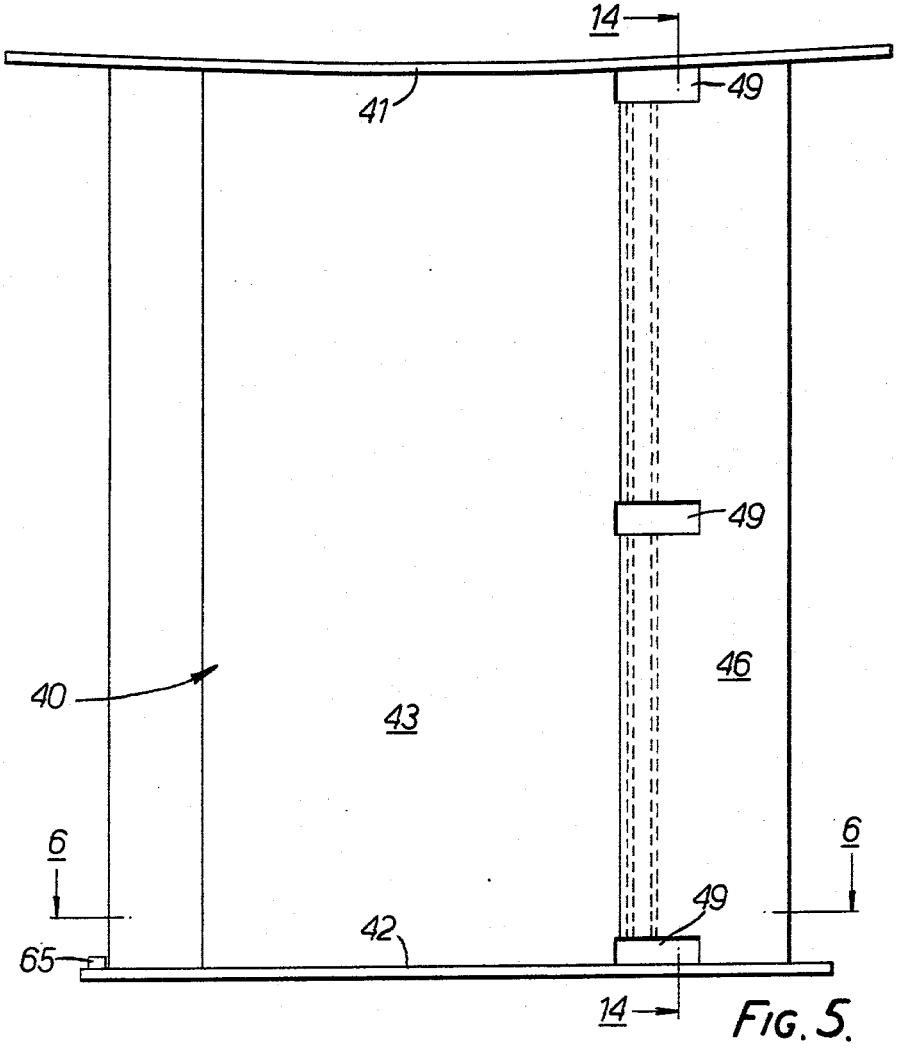
FIG. 5 is a side view of the fixed central supporting member of the keel assembly.
Figure 6:
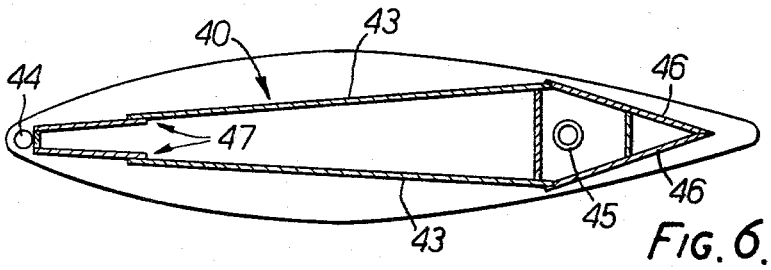
FIG. 6 is a view along the line 6—6 of FIG. 5.

Referring to FIG. 5 and FIG. 6, it will be seen that the fixed central supporting member 40 is massively constructed so as to be able to support the full weight of a boat. For this purpose, the supporting member 40 includes a top plate 41 which is adapted to be secured to the underside of the yacht and a bottom plate 42 arranged as a supporting pad at the lowermost end of the keel. As shown, the structure intermediate the upper and lower plates 41 and 42 is formed as a hollow box section member having side plates 43 which converge forwardly towards a leading pivot bearing 44 and terminate adjacent the aft pivot bearing 45. The rearwardly diverging side plates 46 extend behind the aft pivot bearing 45. The resultant hollow box section member provide a cavity adapted to be filled with ballast which suitably may be lead. The leading portions 47 of the side plates 43 are stepped inwardly as shown so either near portion 48 of the leading pivot assembly may pivot to a position to lie flush with the side plates 43. This is illustrated clearly in FIG. 11 and the arrangement is provided so that the leeward side of the outer section of the keel casing can lie flush along the outer faces of the leading pivot assembly and the box section supporting member 40.

Figure 11:
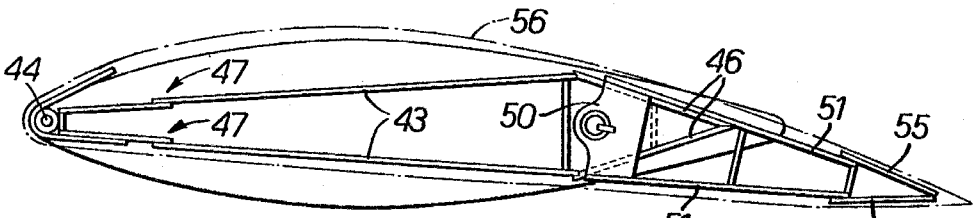
FIG. 11 is a typical cross-sectional view illustrating the operative pivotal connection between the leading and aft pivot assemblies to the central supporting member.

As shown in FIG. 5, there are provided three apertures 49 each of which pass through the box section supporting member 40 at the location of the aft pivot bearing in which respective gudgeons 50 secured by screws between the side faces 51 of the pivot assembly 21 may be located. As shown, each gudgeon is provided with a central aperture 52 for the operating shaft 23 and each aperture 52 is provided with a keyway 53 to enable the gudgeons to be positively locked to the operating shaft 23. As illustrated in FIG. 11, the rearwardly diverging side faces 46 of the central housing 40 are adapted to lie in abutting relationship with a respective side face 51 of the aft pivot assembly when the latter is pivoted to its asymmetrical attitude. The trailing end 54 of the aft pivot assembly is provided with four pairs of rearwardly converging tongues 55 which are welded to the opposite sides 51 of the aft pivot assembly.

Figure 15:
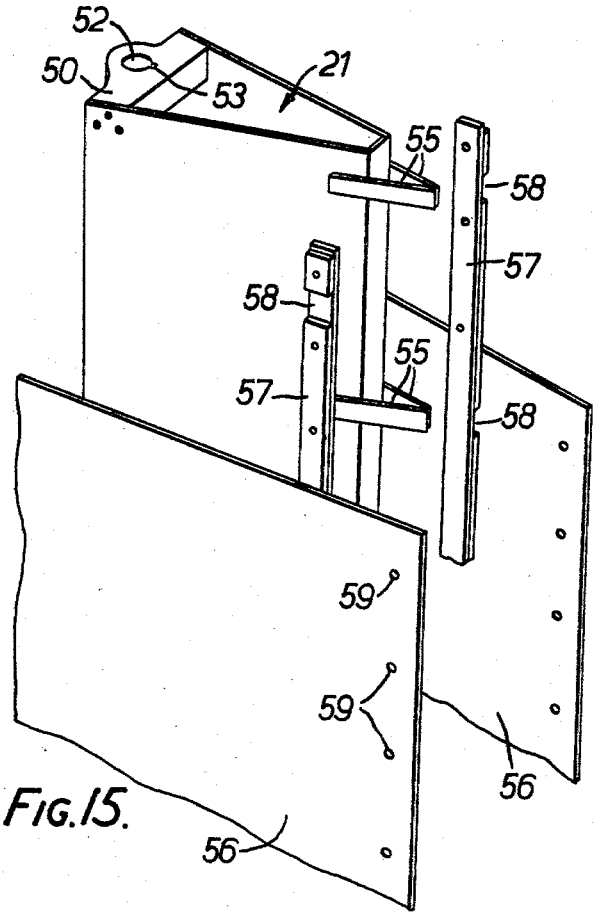
FIG. 15 illustrates the sliding connection between the outer casing of the foil and the aft pivot assembly.

As shown in FIG. 15 the trailing end portions of the outer casing 56 are adapted to be slidably connected to the aft pivot assembly by means of the slotted vertically extending connector members 57 which are provided with spaced gaps 58 along their outer face and which are locatable about the respective tongues 55 whereby the connector members 57 are retained back to back behind the tongues and are slidable longitudinally therealong and relative to one another. The trailing portion of the outer casing 56 is apertured at 59 for screwed connection to the respective connector member so that the trailing ends 56 are held together at the trailing end of the aft pivot assembly but are relatively slidable therealong in the longitudinal direction. This is to enable the sides to move relative to one another to enable the foil shaped casing to articulate from one asymmetrical attitude at which say the foil gives a positive lift to port, to its opposite asymmetrical attitude at which the foil gives a positive lift to starboard.

Figure 12:
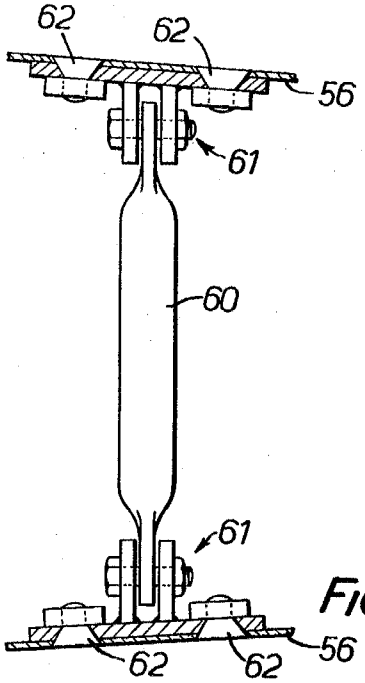
FIG. 12 illustrates the detail of the cross-connecting mechanism between the outer skins of the foil.
Figure 14:
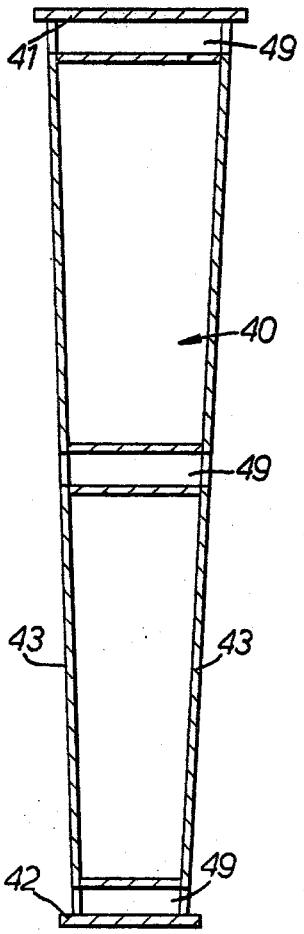
FIG. 14 is a cross-sectional view of the central supporting member taken along the line 14—14 of FIG. 5.

Additionally, the apertures 49 in the central supporting member are provided to enable interconnecting linkages 60 to pass therethrough and which linkages are adapted to be pivotally secured to the respective sides of the outer casing 56 by the pivotal connections 61 illustrated in FIG. 12.

Figure 4:
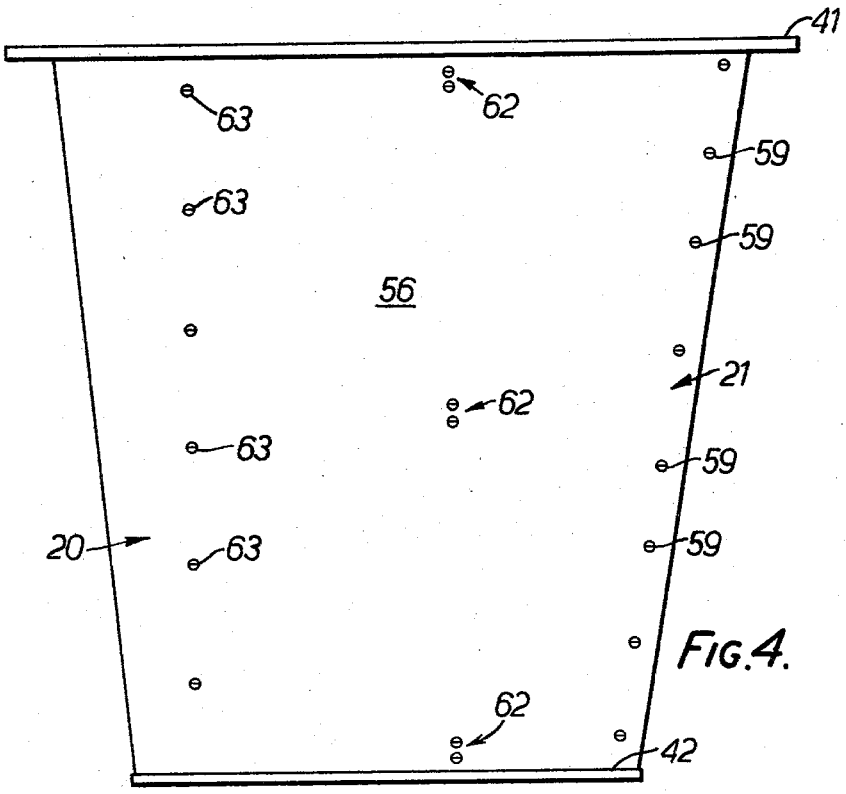
FIG. 4 is a side view of a yacht keel made in accordance with the present invention.
Figure 2:
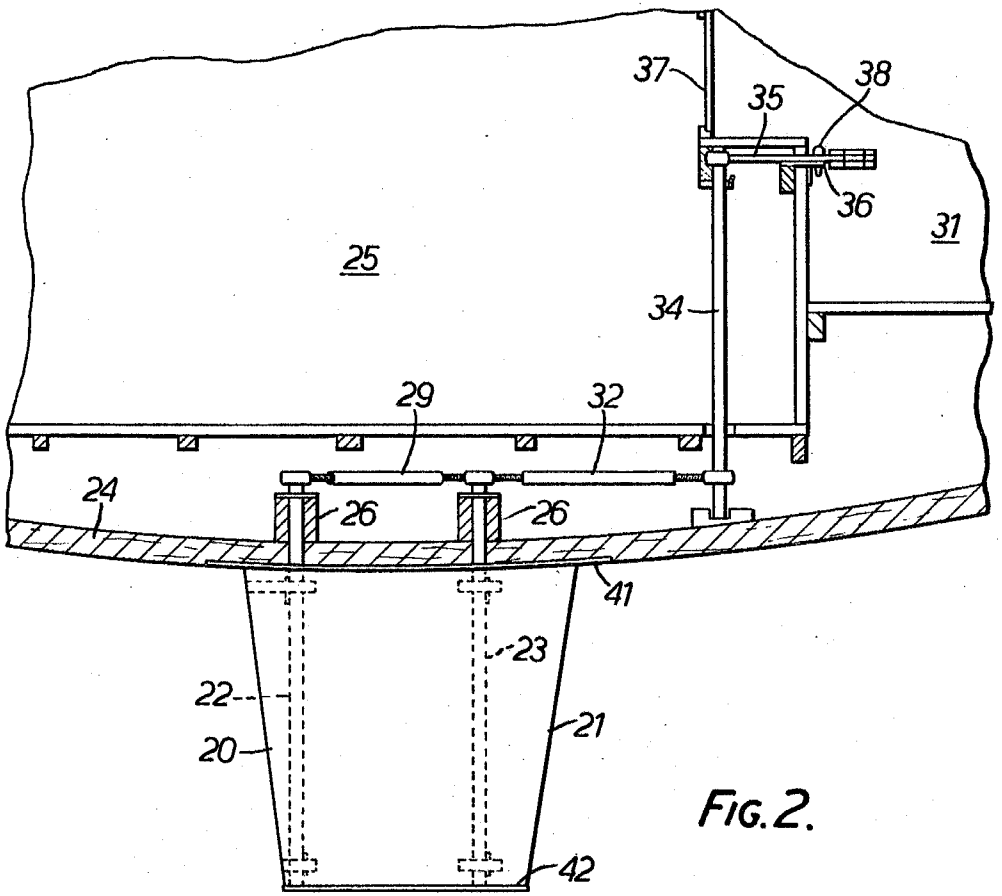
FIG. 2 is a schematic side view illustrating the arrangement of a keel assembly according to the present invention, mounted on a yacht and showing the manual control arrangement of the articulated outer casing of the keel assembly.
Figure 7:
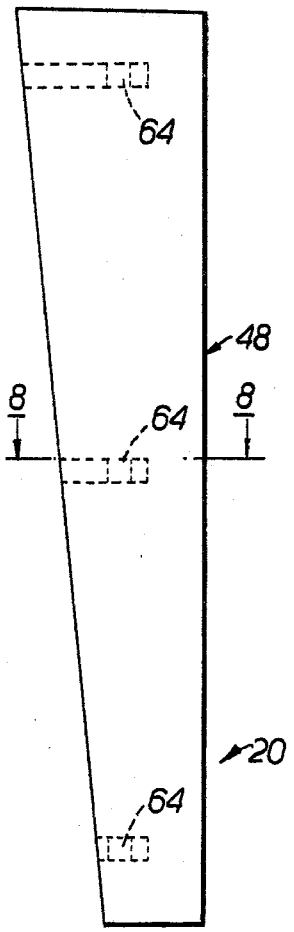
FIG. 7 is a side view of a leading pivot assembly adapted to be connected to the central support member.
Figure 9:
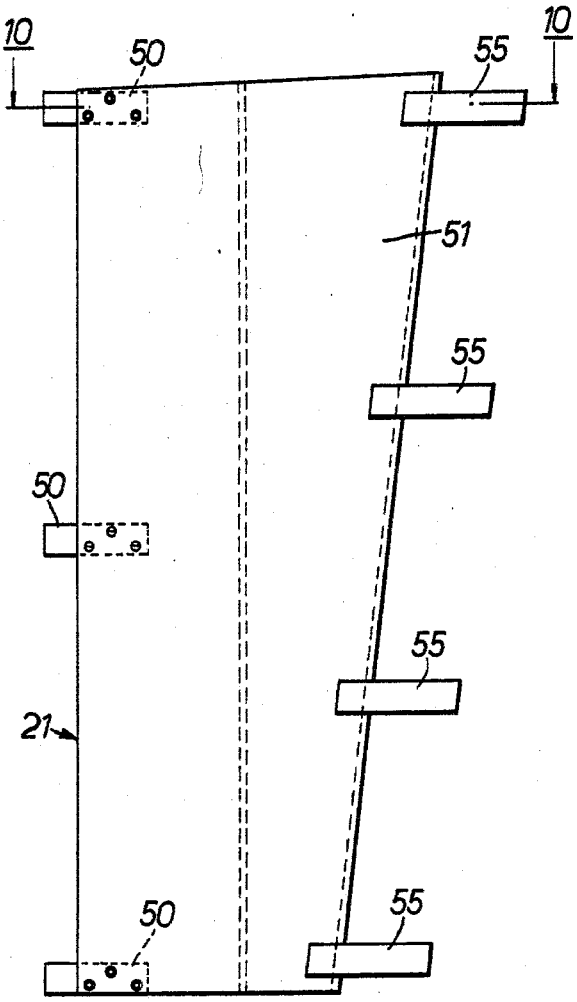
FIG. 9 is a side view of the aft pivot assembly.
Figure 8:
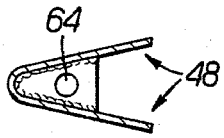
FIG. 8 is a typical cross-section along the line 8—8 of FIG. 7.
Figure 10:
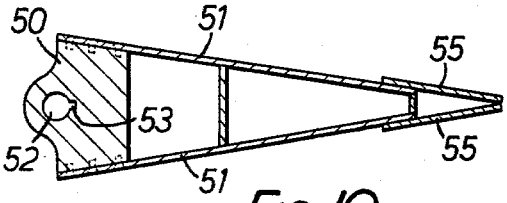
FIG. 10 is a typical cross-sectional view along the line 10—10 of FIG. 9.

As shown in FIG. 4, each respective side of the outer casing 56 is secured at its trailing end by screws thrugh the apertures 59 to the trailing end of the aft pivot assembly 21, by three pairs of screws 62 to the respective linkages 60 which pass through the apertures 49 in the central supporting member and by a row of screws 63 which are adapted to secure the casing to the trailing edge of the leading pivot assembly 20. As illustrated in FIG. 7, the leading pivot assembly is provided with three keyed apertures 64 to enable the leading pivot assembly to be locked to the shaft 22 which is supported between the respective gland 26 and the load pivot bearing 65.

The outer casing is preferably formed from a single sheet of say, stainless steel, which is bent centrally to extend about the leading pivot assembly 20 to pass down either side for connection to the trailing end of the aft pivot assembly as shown in FIG. 7. In its asymmetrical attitude, the leeward side of the outer casing is supported against the side plates 43 and 51 of the central support member and the aft pivot assembly, respectively, while the windward side of the casing bows outward in a convex shape to provide the necessary asymmetrical foil section disposed at a positive angle of attack with respect to the normal fore and aft centreline of the keel. The fin according to the present invention, may be utilised for other purposes than as keels for sailing vessels, such as for example, as stabilizing foils for large vessels.

It will, of course, be realised that while the above has been given by way of illustrative example, many modifications of detail and design may be made to the above described embodiments by persons skilled in the art without departing from the board scope and ambit of the invention.

I claim:

1. A fin assembly of the type having mounting means connectible to the underside of a vessel and a support structure fixed to and extending outwardly from said mounting means for supporting a foil shaped outer casing in a position such that the incidence plane of the foil in symmetrical shape is substantially parallel to the fore and aft axis of the vessel and the sides of the casing are spaced from said support structure, and wherein the casing is formed of flexible material whereby the respective opposite sides of said casing may move towards or away from said support structure to alter shape to an asymmetrical foil, characterised in that said casing is supported between normally freely pivotable fore and aft pivot assemblies connected pivotably about outwardly extending pivot axles disposed substantially parallel to said incidence plane and adjacent the respective leading and trailing edges of said support structure and wherein said aft pivot assembly is pivoted adjacent its leading edge to permit its trailing edge to be displaced laterally either side of its normally symmetrical position, whereby the incidence plane of the asymmetrical foil may be disposed at a positive angle of attack with respect to the said fore and aft axis of the vessel thus increasing the lift/drag ratio of said asymmetrically disposed casing, and torque transferring means comprising a first pivot lever operatively fixed to said fore pivot assembly, an oppositely arranged second pivot lever fixed to said aft pivot assembly and a transfer linkage interconnecting said levers such as to cause the fore and aft pivot assemblies to pivot oppositely to one another, whereby said casing articulates automatically to a respective asymmetrical attitude due to water pressure against a respective side of said casing, the respective sides of the trailing portions of said fore and aft pivot assemblies abutting said support structure when said casing is disposed in a respective said asymmetrical attitude.

2. A fin assembly according to claim 1, wherein the pivot axles of said fore and aft pivot assemblies are fixed for pivotal movement therewith and said first and second pivot levers are disposed internally within said vessel and are secured to the respective said pivot axles which are adapted to extend inwardly to pass sealably through the bottom of the vessel.

3. A fin assembly according to claim 2, wherein there is provided an above deck mounted indicator lever connected operatively to said pivot levers by linkage means to pivot therewith so as to indicate the operative disposition of said fin assembly.

4. A fin assembly according to claim 3, wherein there is provided locking means to secure said indicator lever in a selected position whereby the operative disposition of the fin assembly may be selectively controlled.

5. A fin assembly according to claim 1 or claim 2, wherein said casing is folded centrally about said fore pivot assembly and is secured thereto and extends rearwardly to the trailing portion of said aft pivot assembly at which the respective trailing portions of said casing sides are connected slidably to the trailing end of said aft pivot assembly for independent slidable movement therealong in the fore and aft direction.

6. A fin assembly according to claim 5, wherein the aspect ratio of said fin is as 1 is to 1.25 or greater and tapers outwardly from said vessel.

* * * * *

UNITED STATES PATENT AND TRADEMARK OFFICE

CERTIFICATE OF CORRECTION

PATENT NO. : 4,280,433

DATED : July 28, 1981

INVENTOR(S) : Cecil F. Haddock

It is certified that error appears in the above-identified patent and that said Letters Patent are hereby corrected as shown below:

Column 3, line 48 "feel" should be "keel"

Column 4, line 61, "or" should be "of"

Column 6, line 10, "thrugh" should be "through"

Signed and Sealed this

*Tenth* Day of *November 1981*

[SEAL]

*Attest:*

GERALD J. MOSSINGHOFF

*Attesting Officer*

*Commissioner of Patents and Trademarks*